US011313070B2

(12) United States Patent
Chang et al.

(10) Patent No.: US 11,313,070 B2
(45) Date of Patent: Apr. 26, 2022

(54) CLOTHES CARE APPARATUS

(71) Applicant: Samsung Electronics Co., Ltd., Suwon-si (KR)

(72) Inventors: Sung Ho Chang, Suwon-si (KR); Dong Wook Kim, Suwon-si (KR); Kwon Chul Yun, Suwon-si (KR); Yong Joon Jang, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 247 days.

(21) Appl. No.: 16/567,268

(22) Filed: Sep. 11, 2019

(65) Prior Publication Data

US 2020/0080250 A1 Mar. 12, 2020

(30) Foreign Application Priority Data

Sep. 12, 2018 (KR) ..... 10-2018-0109244

(51) Int. Cl.

| | |
|---|---|
| ***D06F 58/10*** | (2006.01) |
| ***D06F 73/02*** | (2006.01) |
| ***A47B 61/00*** | (2006.01) |
| ***D06F 37/28*** | (2006.01) |
| ***D06F 59/02*** | (2006.01) |

(52) U.S. Cl.

CPC ..... *D06F 58/10* (2013.01); *A47B 61/003* (2013.01); *D06F 37/28* (2013.01); *D06F 59/02* (2013.01); *D06F 73/02* (2013.01)

(58) Field of Classification Search

CPC ..... A47B 61/003; D06F 37/28; D06F 58/10; D06F 59/02; D06F 73/02

USPC ..... 223/85; 312/408, 410, 351

See application file for complete search history.

(56) References Cited

U.S. PATENT DOCUMENTS

| | | | | |
|---|---|---|---|---|
| 4,221,354 A * | 9/1980 | Kempkers | A47G 25/065 | 248/291.1 |
| 6,986,488 B2 * | 1/2006 | Migli | A47B 96/066 | 248/239 |
| 8,376,300 B2 * | 2/2013 | Nishida | B60R 7/08 | 248/304 |
| 9,016,642 B1 * | 4/2015 | Ay | B60R 7/10 | 248/205.1 |

(Continued)

FOREIGN PATENT DOCUMENTS

| | | |
|---|---|---|
| EP | 2343216 | 7/2013 |
| JP | 2003-79999 | 3/2003 |

(Continued)

OTHER PUBLICATIONS

International Search Report dated Feb. 5, 2020 in International Patent Application No. PCT/KR2019/011800.

(Continued)

*Primary Examiner* — James O Hansen
(74) *Attorney, Agent, or Firm* — Staas & Halsey LLP

(57) ABSTRACT

Disclosed is a clothes care apparatus including a holder unit improved to support a rack. The clothes care apparatus a main body including a care compartment for accommodating clothes, a rack detachably disposed inside the care compartment, and a holder unit configured to support the rack and including a housing coupled to the care compartment and a holder rotatably provided to be received in the housing or protrude from the housing.

7 Claims, 12 Drawing Sheets

(56) References Cited

U.S. PATENT DOCUMENTS

| | | | | |
|---|---|---|---|---|
| 2007/0284983 | A1* | 12/2007 | Wayner | A47B 96/06<br>312/351 |
| 2016/0131416 | A1* | 5/2016 | Sankhgond | F25D 23/067<br>312/408 |

FOREIGN PATENT DOCUMENTS

| | | | |
|---|---|---|---|
| KR | 1999-0030412 | U | 7/1999 |
| KR | 20-0182199 | | 6/2000 |
| KR | 10-2003-0065335 | | 8/2003 |
| KR | 10-0654992 | | 12/2006 |
| KR | 10-0658843 | | 12/2006 |
| KR | 10-2012-0113645 | A | 10/2012 |
| KR | 10-2014-0108454 | | 9/2014 |
| KR | 10-1834294 | B1 | 4/2018 |
| WO | WO 2011/149320 | A2 | 12/2011 |

OTHER PUBLICATIONS

Extended European Search Report dated Jul. 12, 2021 from European Application No. 19860399.5.

* cited by examiner

CLOTHES CARE APPARATUS

CROSS-REFERENCE TO RELATED APPLICATIONS

This application is based on and claims priority under 35 U.S.C. § 119 to Korean Patent Application No. 10-2018-0109244, filed on Sep. 12, 2018, in the Korean Intellectual Property Office, the disclosure of which is incorporated by reference herein in its entirety.

BACKGROUND

1. Field

The disclosure relates to a clothes care apparatus including a holder unit improved to support a rack.

2. Description of the Related Art

A clothes care apparatus is an apparatus that performs the clothes care, such as drying clothes, removing dust stuck to clothes or odor that has permeated into clothes, and reducing creases of clothes.

The clothes care apparatus may include a heat exchange device configured to supply hot air to a care compartment where clothes are accommodated to dry the clothes, and a steam generation device configured to perform a refresh function such as crease removal, odor removal, and static electricity removal of clothes and the like.

The clothes care apparatus may include a main body for forming the care compartment accommodating clothes. A machine compartment in which the steam generation device or the heat exchange device is disposed may be disposed below the care compartment. The care compartment and the machine compartment may be separated.

The clothes care apparatus dries clothes accommodated in the care compartment with the heat exchange device provided in the machine compartment, and the air moistened by the drying of the clothes may be dehumidified by the heat exchange device and supplied again to the inside of the care compartment.

As a method of accommodating clothes in the clothes care apparatus, there may be a method of hanging clothes using a hanger and a method of placing clothes on a rack. In general, clothes formed of a material such as cotton may be accommodated using the hanger, and clothes having elasticity such as knits may be accommodated by being placed on the rack.

The rack may be detachably coupled to the inside of the care compartment. Therefore, the rack may be mounted to the inside of the care compartment when clothes such as knits are accommodated, and the rack may be detached from the inside of the care compartment when clothes made of a material such as cotton are accommodated.

SUMMARY

It is an aspect of the disclosure to provide a clothes care apparatus including a holder unit having an improved structure to support a rack.

It is another aspect of the disclosure to provide a clothes care apparatus including a holder improved to be received in a housing or protrude from the housing.

It is another aspect of the disclosure to provide a clothes care apparatus including a holder unit improved to prevent air inside a care compartment from leaking outside the care compartment.

Additional aspects of the disclosure will be set forth in part in the description which follows and, in part, will be obvious from the description, or may be learned by practice of the disclosure.

In accordance with an aspect of the disclosure, a clothes care apparatus includes a main body including a care compartment for accommodating clothes, a rack detachably disposed inside the care compartment, and a holder unit configured to support the rack and including a housing coupled to the care compartment and a holder rotatably provided to be received in the housing or protrude from the housing.

The holder may include a holder body configured to support the rack and a shaft protruding from the holder body to pivotally rotate the holder.

The housing may include a housing body including a receiving portion configured to receive the holder, and a shaft hole provided on the housing body to couple the shaft.

The care compartment may include a coupling portion configured to detachably couple the holder unit, and the holder unit may be coupled to the holder unit in a fitting manner.

The housing may include a separation prevention portion provided at an edge of the housing body to prevent the housing from being separated from the coupling portion.

The housing may further include a locking portion configured such that the holder is received in the receiving portion, and the holder may further include a locking groove configured such that the rotation of the holder is prevented by the locking portion.

The holder may further include an inclined portion on which the locking groove is disposed and configured to be inclined toward the locking portion such that the locking portion is locked or unlocked to the locking groove.

The housing may further include a fixing portion protruding from the housing body such that the housing is fixed to the coupling portion.

The coupling portion of the care compartment to which the holder unit is coupled may be disposed between the fixing portion and the separation prevention portion.

The fixing portion may include a first fixing part configured to fix the holder unit to the coupling portion and a second fixing part having elasticity to fix or separate the holder unit to or from the coupling portion.

The fixing portion may include a step stepped toward the coupling portion such that the housing is in close contact with the coupling portion.

The holder unit may include a cap detachably provided at the housing body to cover a housing hole of the housing.

The clothes care apparatus may further include a door rotatably coupled to the main body to open and close the care compartment and a support member provided in the care compartment to support the rack, wherein the holder unit may be spaced apart from the support member and disposed between the support member and the door.

The holder body may include a rack support portion configured to support the rack, and a rotation prevention portion configured to be opposite to the rack support portion and to be interfered by the housing to prevent the rotation of the holder.

The rack may include a plurality of support grooves symmetrically provided on opposite sides of the rack such that the rack is supported on the holder.

In accordance with another aspect of the disclosure, a clothes care apparatus includes a main body including a care compartment for accommodating clothes, a door coupled to the main body, a rack detachably disposed inside the care compartment and including a first rack body directing to the door and a second rack body symmetrically opposite the first rack body, and a holder unit configured to support the rack and including a housing coupled to the care compartment and a holder rotatably and pivotally provided to be received in the housing or protrude from the housing, wherein the housing includes a locking portion supporting the holder such that the holder is received in the housing, and the holder includes a locking groove configured such that the holder is locked or unlocked by the locking portion.

The rack may be disposed on the holder such that the first rack body is adjacent to the door or the second rack body is adjacent to the door.

The rack may include a plurality of support grooves provided symmetrically on opposite sides of the rack such the rack is placed on the holder and is separated from the holder in a direction opposite to the direction in which the rack is placed on the holder.

In accordance with another aspect of the disclosure, a clothes care apparatus includes an outer cabinet, an inner cabinet disposed inside the outer cabinet and accommodating clothes, a rack detachably disposed inside the inner cabinet, and a holder unit configured to support the rack and including a housing coupled to a coupling portion of the inner cabinet and covered by the outer cabinet and a holder movably provided to be received in the housing or protrude from the housing, wherein the housing includes a fixing portion provided such that the housing is fixed to the coupling portion and a separation prevention portion provided such that the housing is prevented from being separated from the coupling portion.

The fixing portion may be disposed between the inner cabinet and the outer cabinet.

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

Figure 1:
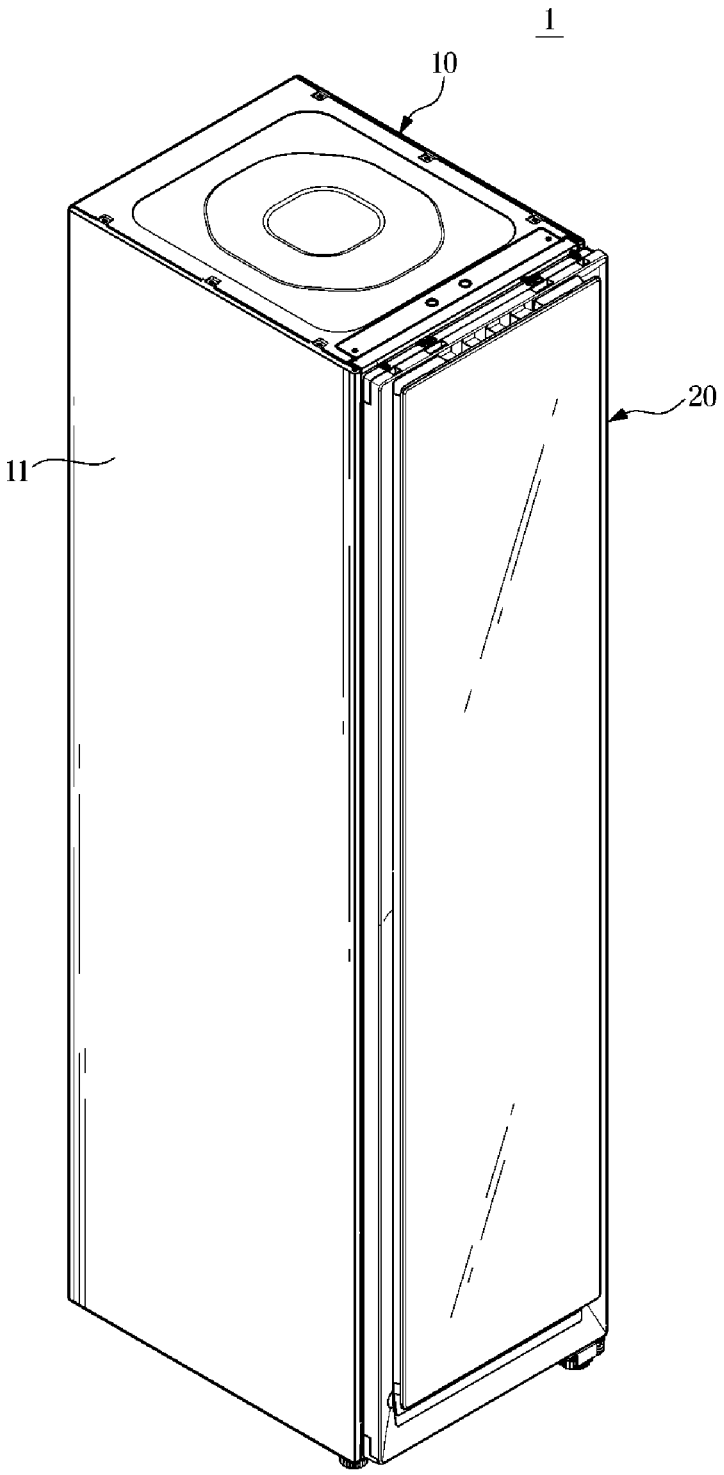
FIG. 1 is a perspective view of a clothes care apparatus according to an embodiment of the disclosure.

The embodiments described herein and the configurations shown in the drawings are only examples of preferred embodiments of the disclosure, and various modifications may be made at the time of filing of the disclosure to replace the embodiments and drawings of the present specification.

Like reference numbers or signs in the various figures of the application represent parts and components that perform substantially the same functions.

The terms used herein are for the purpose of describing the embodiments and are not intended to restrict and/or to limit the disclosure. For example, the singular expressions herein may include plural expressions, unless the context clearly dictates otherwise.

The terms "comprises" and "has" are intended to indicate that there are features, numbers, steps, operations, elements, parts, or combinations thereof described in the specification, and do not exclude the presence or addition of one or more other features, numbers, steps, operations, elements, parts, or combinations thereof.

It will be understood that, although the terms first, second, etc. may be used herein to describe various components, these components should not be limited by these terms. These terms are only used to distinguish one component from another.

For example, without departing from the scope of the disclosure, the first component may be referred to as a second component, and similarly, the second component may also be referred to as a first component. The term "and/or" includes any combination of a plurality of related items or any one of a plurality of related items.

In this specification, the terms "front," "rear," "upper," "lower," "left," and "right" are defined with reference to the drawings, and the shape and position of each component are not limited by these terms.

Hereinafter, a clothes care apparatus according to an embodiment of the disclosure will be described in detail with reference to the drawings.

Figure 2:
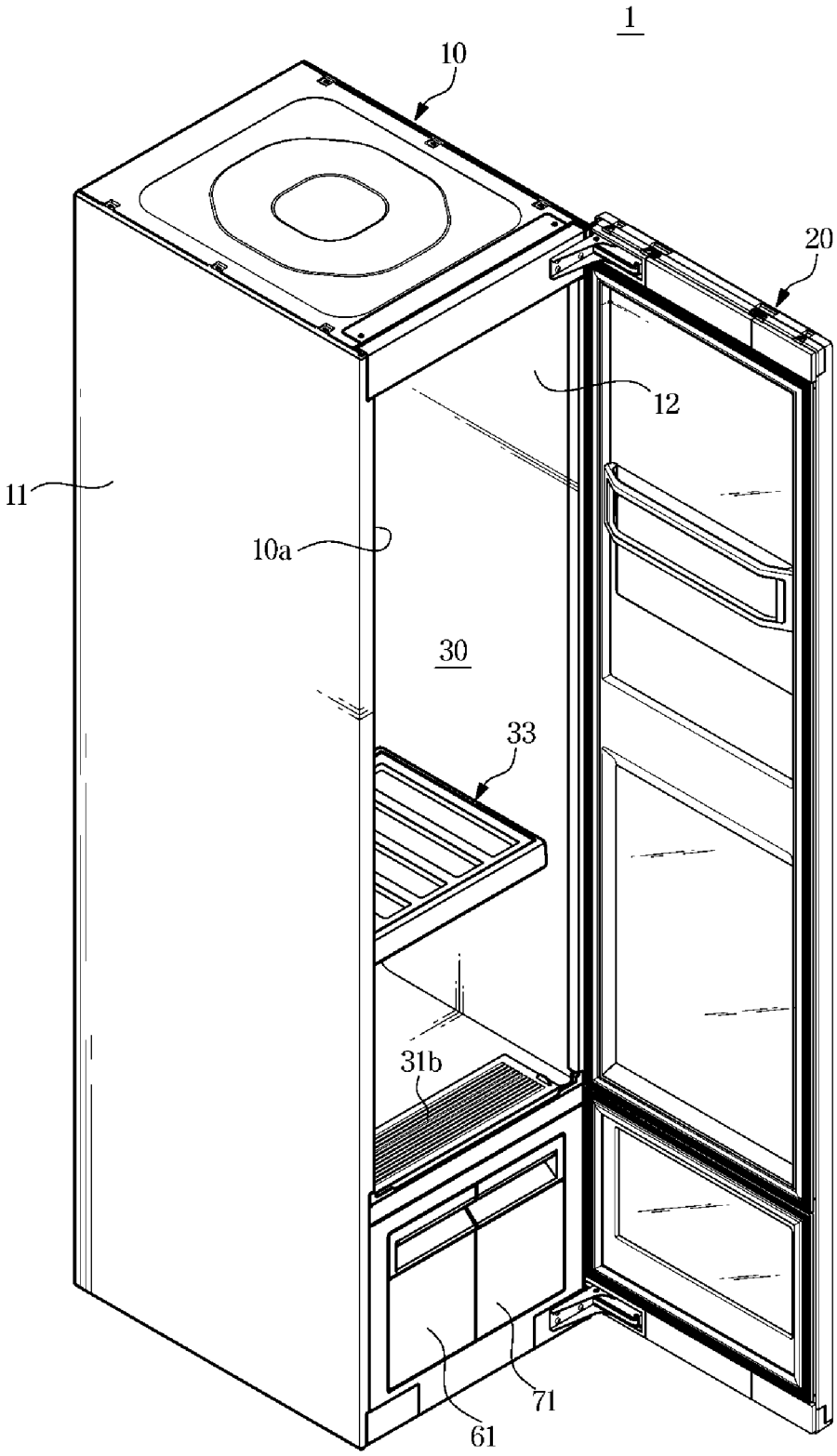
FIG. 2 is a view illustrating a state in which a door of the clothes care apparatus according to an embodiment of the disclosure is opened.

FIG. 1 is a perspective view of a clothes care apparatus according to an embodiment of the disclosure, and FIG. 2 is a view illustrating a state in which a door of the clothes care apparatus according to an embodiment of the disclosure is open.

As illustrated in FIGS. 1 and 2, a clothes care apparatus 1 may include a main body 10 forming an appearance and a door 20 rotatably coupled to the main body 10. The main body 10 may include an outer cabinet 11 and an inner cabinet disposed inside the outer cabinet 11.

The main body 10 may have a substantially hexahedral shape with one surface open. An opening 10*a* may be formed on a front surface of the main body 10. A door 20 may be rotatably coupled to the opening 10*a* to open and close a care compartment 30.

Although not shown in the drawings, the door 20 may be installed to the main body 10 to open and close the opening 10*a* through a hinge or a link.

The main body 10 may include the care compartment 30 provided inside the main body 10 to accommodate and care clothes. A front surface of the care compartment 30 may be formed to be open. The opening of the care compartment 30 may also be opened and closed together by the door 20 that opens and closes the opening 10*a*.

The clothes care apparatus 1 may include a rack 33 provided to accommodate clothes in the care compartment 30. Detailed description of the structure of the rack 33 will be described later.

Figure 3:
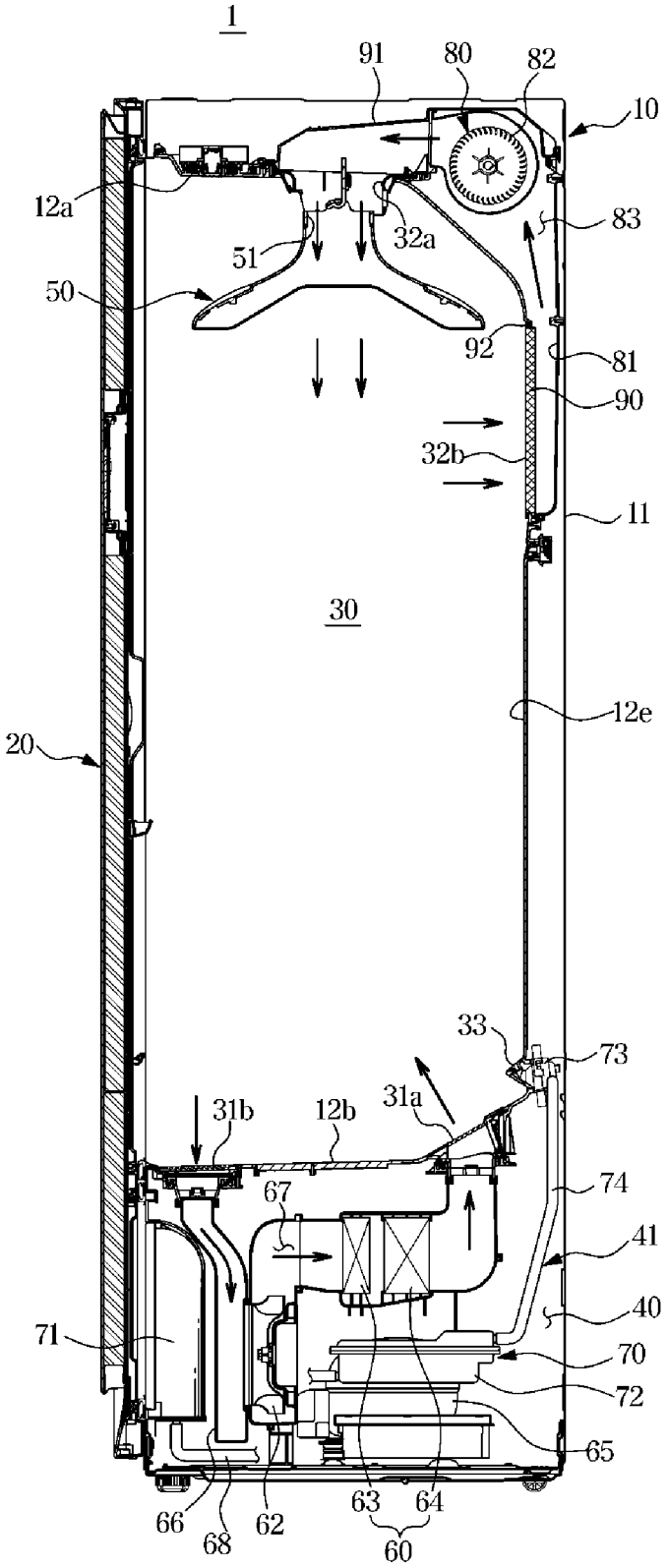
FIG. 3 is a side cross-sectional view of the clothes care apparatus according to an embodiment of the disclosure.
Figure 4:
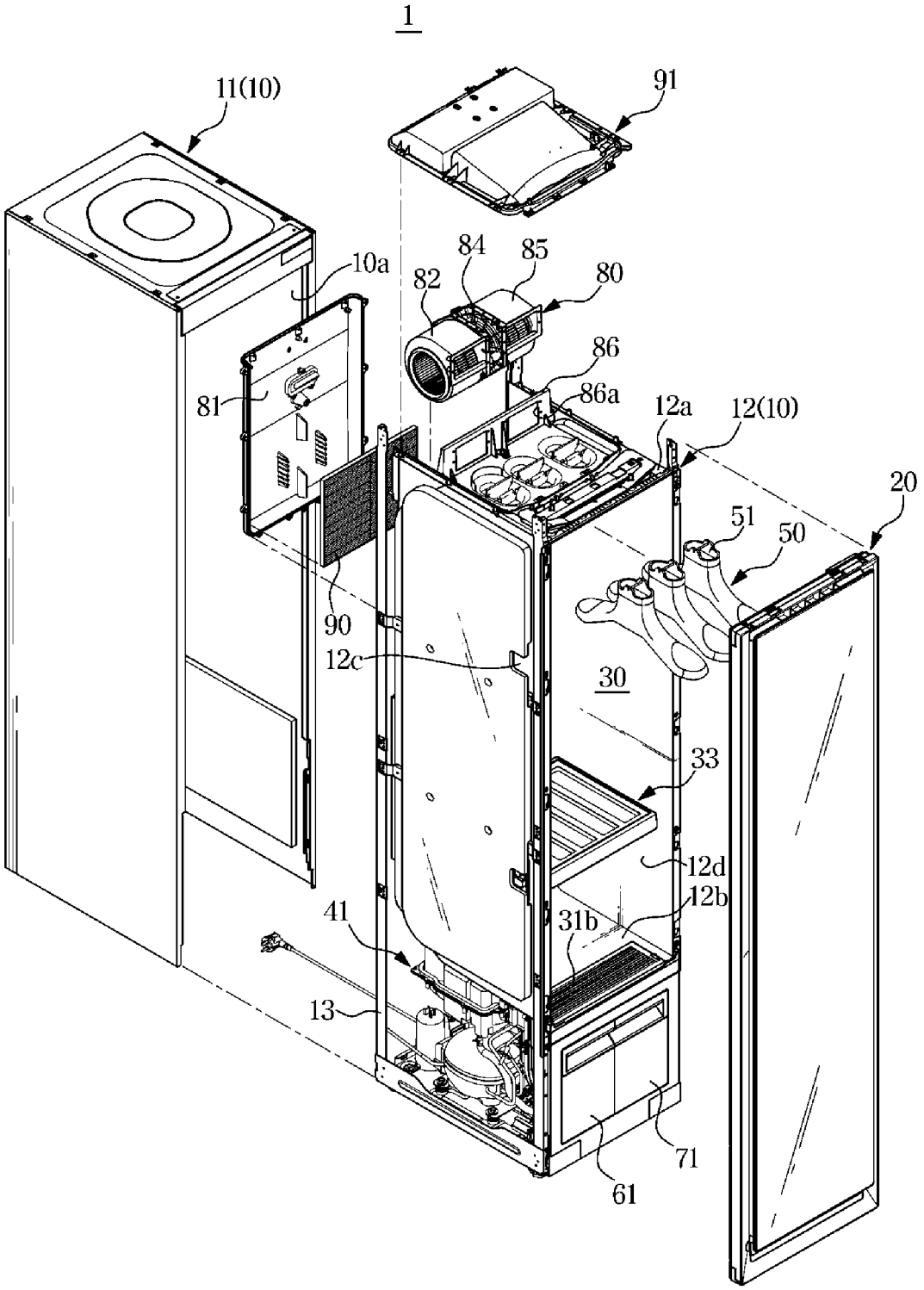
FIG. 4 is an exploded perspective view of the clothes care apparatus according to an embodiment of the disclosure.

FIG. 3 is a side cross-sectional view of the clothes care apparatus according to an embodiment of the disclosure, and FIG. 4 is an exploded perspective view of the clothes care apparatus according to an embodiment of the disclosure. As illustrated in FIGS. 3 and 4, the main body 10 may include a hanging member 50 provided inside the care compartment 30 to hang clothes.

The main body 10 may include a machine compartment 40 in which a base module 41 such as a heat exchange device 60 provided to dehumidify or heat air in the care compartment 30 is accommodated.

The care compartment 30 may form a space in which clothes are accommodated. The care compartment 30 may include an upper surface 12*a*, a lower surface 12*b*, a left surface 12*c*, a right surface 12*d*, and a rear surface 12*e* provided in an inner cabinet 12.

The inner cabinet 12 may include a frame 13 (refer to FIG. 4) provided to support the upper surface 12*a*, the lower surface 12*b*, the left surface 12*c*, the right surface 12*d*, and the rear surface 12*e*.

The frame 13 may form the care compartment 30 and the machine compartment 40 disposed below the care compartment 30, but is not limited thereto.

The hanging member 50 may be installed on the upper surface 12*a* of the care compartment 30. The hanging member 50 may be detachably installed in the care compartment 30. One or more of the hanging members 50 may be provided. The hanging member 50 may be formed in a hanger shape so that clothes may be fitted.

The hanging member 50 may be provided to allow air to flow through the inside thereof. Dust or foreign substances stuck to the clothes may be removed by the air supplied to the inside of the hanging member 50.

The hanging member 50 may be provided with an air hole 51 for supplying air to clothes. The air hole 51 may be formed at an upper end of the hanging member 50, and air may be supplied to the inside and the outside of clothes through the air hole 51.

However, the disclosure is not limited to the above configuration, and the air hole 51 may be formed in various sizes at various positions so that the supplied air may be widely injected on clothes.

The care compartment 30 may include a first inlet 31*a*, a second inlet 32*a*, a first outlet 31*b*, a second outlet 32*b*, and a steam inlet 33.

The first inlet 31*a* and the first outlet 31*b* may be formed at the lower surface 12*b* of the care compartment 30. The first inlet 31*a* may be disposed at a rear portion of the lower surface 12*b* of the care compartment 30. The first outlet 31*b* may be disposed at a front portion of the lower surface 12*b* of the care compartment 30. The first inlet 31*a* and the first outlet 31*b* may be disposed adjacent to each other.

The steam inlet 33 may be disposed at a lower portion of the rear surface 12*e* of the care compartment 30. The steam inlet 33 may be disposed above the first inlet 31*a*.

The second inlet 32*a* may be formed at an upper portion of the upper surface 12*a* of the care compartment 30. The second outlet 32*b* may be formed at a central portion of the rear surface 12*e* of the care compartment 30. The second inlet 32*a* and the second outlet 32*b* may be disposed adjacent to each other.

The second inlet 32*a* of the care compartment 30 may be connected to the hanging member 50. The air introduced through the second inlet 32*a* may be delivered to the hanging member 50 through the air hole 51 and may be delivered to the clothes hanging on the hanging member 50.

A drain container 61 and a water supply container 71 that are detachably provided from the main body 10 may be installed at a lower portion of the main body 10. The drain container 61 and the water supply container 71 may be disposed at a lower portion of the care compartment 30.

The drain container 61 may be provided to facilitate the treatment of condensed water by the heat exchange device 60. The water supply container 71 may store water required to generate steam in the steam generation device 70.

The water in the water supply container 71 may be supplied to the steam generation device 70 and used to generate steam. The water supply container 71 may be detachably installed from the main body 10 to facilitate water replenishment.

The drain container 61 and the water supply container 71 may be provided in the front of the machine compartment 40. The machine compartment 40 may be provided at the lower portion of the main body 10. The machine compartment 40 may be provided at the lower portion of the care compartment 30.

The machine compartment 40 in which the base module 41 is installed may be disposed at a lower portion of the inner cabinet 12. The base module 41 may include the heat exchange device 60, the steam generation device 70, or various hoses 68. The various hoses 68 may be used in the heat exchange device 60 and the steam generation device 70, respectively.

The heat exchange device 60 may be provided to dehumidify and heat air in the care compartment 30 as necessary. The base module 41 may include the heat exchange device 60, a first fan 62, and the steam generation device 70.

The heat exchange device 60 may be installed to supply hot air into the care compartment 30. The heat exchange device 60 may include an evaporator 63, a condenser 64, and a compressor 65 through which a refrigerant circulates, and may be provided to dehumidify and heat air.

As the refrigerant evaporates in the evaporator 63 of the heat exchange device 60, the evaporator 63 may absorb latent heat of the surrounding air, thereby condensing and removing moisture in the air.

When the refrigerant is condensed in the condenser 64 after passing through the compressor 65, the refrigerant may heat the surrounding air by releasing the latent heat toward the surrounding air.

The evaporator 63 and the condenser 64 perform a heat exchange function, so that the air introduced into the machine compartment 40 by the first fan 62 may dehumidify and be heated by passing through the evaporator 63 and the condenser 64 sequentially.

The heat exchange device 60 installed in the machine compartment 40 may include a first duct 66 connecting the evaporator 63, the condenser 64, and the first fan 62, and the first duct 66 may be connected to the care compartment 30 to form a first flow passage 67 that circulates between the care compartment 30 and the first duct 66.

The first duct 66 may be connected to the first inlet 31*a* and the first outlet 31*b* of the care compartment 30. One end of the first duct 66 may be connected to the first inlet 31*a*, and the other end may be connected to the first outlet 31*b*.

The air in the care compartment 30 may be introduced into the first duct 66 through the first outlet 31*b*, and the introduced air may be dehumidified and introduced back into the care compartment 30 through the first inlet 31*a*.

The first inlet 31*a* may be disposed in the rear of the care compartment 30, and the first outlet 31*b* may be disposed in the front of the care compartment 30. However, the disclosure is not limited thereto. For example, the positions of the first inlet 31*a* and the first outlet 31*b* may be variously changed as necessary.

The first duct 66 may be provided to dehumidify the air introduced through the first outlet 31*b* and discharge the dehumidified air to the first inlet 31*a*. The first fan 62 may be provided on the first duct 66 to suck the air in the care compartment 30 into the first duct 66.

The base module 41 may include the steam generation device 70 for receiving water from the water supply container 71 to generate steam. The steam generation device 70 may be disposed in the machine compartment 40.

The steam generation device 70 may include a steam generator 72 connected to the water supply container 71 and receiving water to generate steam, and a steam supply pipe 74 for guiding the generated steam to a steam injector 73.

The steam injector 73 may be disposed at the lower portion of the rear surface 12*e* of the care compartment 30. A heater (not shown) may be installed inside the steam generator 72 to heat water.

The care compartment 30 may include a blowing device 80 for flowing aft inside the care compartment 30. The blowing device 80 may include a second duct 81, and a second fan 82 may be installed inside the second duct 81.

The second duct 81 may be provided to be in communication with the care compartment 30 to form a second flow passage 83 that circulates through the care compartment 30 and the second duct 81. The second fan 82 may be disposed on the second flow passage 83.

The second duct 81 may be formed at the rear of the second outlet 32*b* of the care compartment 30. The second duct 81 may be provided at an upper portion of the rear surface 12*e* of the care compartment 30 and may include a filter 90 therein.

The filter 90 may include a HEPA (High Efficiency Particulate Air) filter, but is not limited thereto. The second duct 81 may be coupled to a top cover 91 disposed at an upper portion of the care compartment 30.

The blowing device 80 may be disposed in the rear of the upper portion of the care compartment 30 and may include a motor for generating a rotational force and the at least one second fan 82 rotated by the motor 84.

A shaft of the motor 84 protrudes to opposite sides, and the second fans 82 may be coupled to the opposite ends of the shaft, respectively. Through this structure, a pair of the second fans 82 may be rotated by one of the motor 84.

The pair of second fans 82 may be provided as centrifugal fans that suck air in an axial direction and discharge air outward in a radial direction, but are not limited thereto.

The second fans 82 may be accommodated by a fan case 85. The fan case 85 may be coupled to a duct bracket 86 provided on the upper surface 12*a* of the care compartment 30.

At least one duct hole 86*a* may be formed on the duct bracket 86, and the second fans 82 may be coupled to the at least one duct hole 86*a*, respectively, to move air in the second duct 81 to the second inlet 32*a*.

The second duct 81 may be connected to the second inlet 32*a* and the second outlet 32*b* of the care compartment 30. One end of the second duct 81 may be connected to the second inlet 32*a*, and the other end may be connected to the second outlet 32*b* of the care compartment 30.

The second inlet 32*a* may be connected to the hanging member 50 so that air in the second duct 81 may be delivered to the hanging member 50.

The second fan 82 disposed inside the second duct 81 may be provided to suck air in the care compartment 30 through the second outlet 32*b* and discharge the sucked air into the second inlet 32*a*.

A filter installation portion 92 for installing the filter 90 may be provided on the rear surface 12*e* of the care compartment 30. The second inlet 32*a* may be formed at a position corresponding to the filter installation portion 92.

The air in the care compartment 30 may be filtered by the filter 90 in the second outlet 32*b* as it enters the second duct 81. Dust and odor in the air introduced into the second duct 81 may be removed by the filter 90.

The air filtered by the filter 90 may be discharged to the hanging member 50 through the blowing device 80. The filter 90 may include a dust collecting filter (not shown) for removing dust or a means for deodorization.

When clothes are managed in the care compartment 30, the clothes care apparatus 1 may be operated in a state in which the clothes are hung on the hanging member 50 and the door 20 is closed. Air may circulate through the care compartment 30 via the first flow passage 67 and the second flow passage 83.

Figure 5:
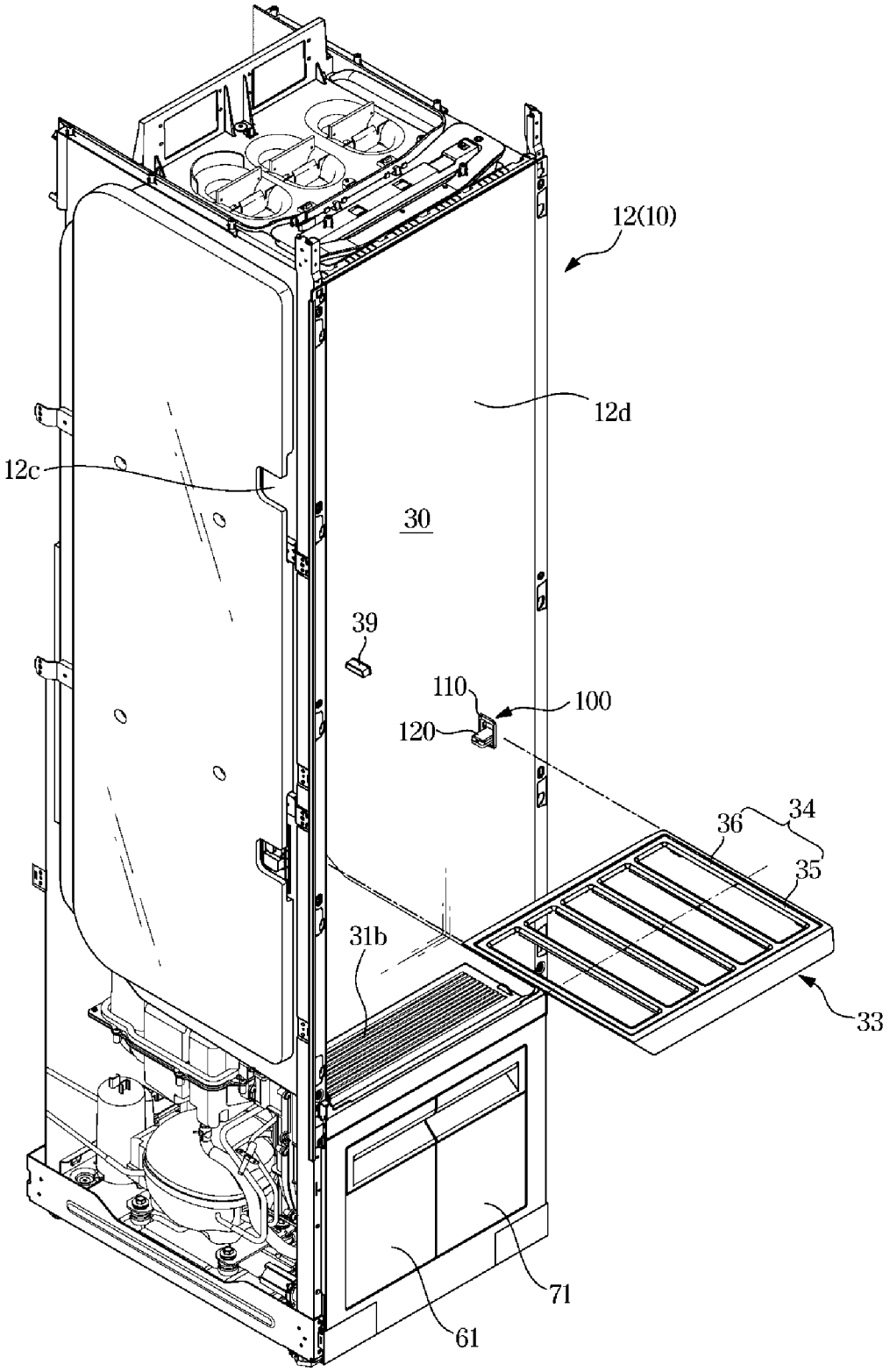
FIG. 5 is a view illustrating a rack detached from a care compartment in the clothes care apparatus according to an embodiment of the disclosure.
Figure 6:
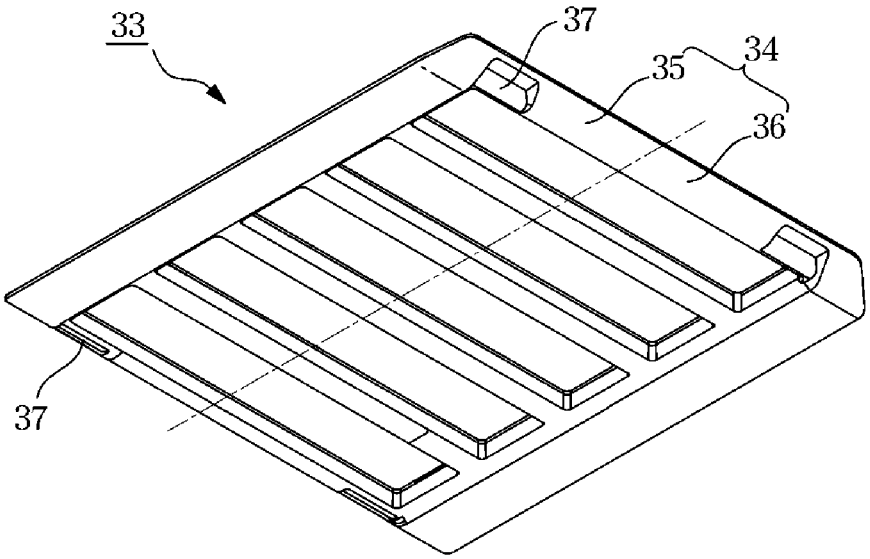
FIG. 6 is a bottom perspective view illustrating the rack in the clothes care apparatus according to an embodiment of the disclosure.

FIG. 5 is a view illustrating a rack detached from a care compartment in the clothes care apparatus according to an embodiment of the disclosure, and FIG. 6 is a bottom perspective view illustrating the rack in the clothes care apparatus according to an embodiment of the disclosure.

As illustrated in FIGS. 5 and 6, the clothes care apparatus 1 (refer to FIG. 1) according to an embodiment of the disclosure may include the rack 33 detachably disposed in the inside of the care compartment 30.

One of the rack 33 is illustrated in FIG. 5, but is not limited thereto. That is, a plurality of the racks 33 may be provided in layers.

The clothes care apparatus 1 may include a holder unit 100 provided in the care compartment 30 to support the rack 33. A plurality of the holder units 100 may be provided. Two of the holder units 100 may be configured to be provided on the left surface 12*c* (refer to FIG. 4) and the right surface 12*d* of the care compartment 30, respectively. However, the disclosure is not limited thereto.

The clothes care apparatus 1 may include a support member 39 provided in the care compartment 30 to support the rack 33. A plurality of the support members 39 may be provided. Two of the support members 39 may be configured to be provided on the left surface 12*c* and the right surface 12*d* of the care compartment 30, respectively. However, the disclosure is not limited thereto.

The rack 33 may be supported by the support member 39 and the holder unit 100 to be detachably disposed in the care compartment 30. The rack 33 may be supported by two of the support members 39 that are provided on the left surface 12*c* and the right surface 12*d* of the care compartment 30, respectively, and two of the holder units 100 that are provided on the left surface 12*c* and the right surface 12*d* of the care compartment 30, respectively.

However, the disclosure is not limited thereto, and the rack 33 may be supported only by two of the holder units 100 provided on the left side 12*c* of the care compartment 30 and two of the holder units 100 provided on the right side 12*d* of the care compartment 30, that is, only by four of the holder units 100.

The holder unit 100 may be provided to be spaced apart from the support member 39. The holder unit 100 may be disposed between the support member 39 and the door 20 (refer to FIG. 2). The distance between the holder unit 100 and the door 20 may be shorter than the distance between the support member 39 and the door 20.

The holder unit 100 may be disposed in the front of the care compartment 30 more than the support member 39. However, the disclosure is not limited thereto.

Therefore, unlike the support member 39 having a fixed position, by arranging the movable holder unit 100 to be adjacent to the door 20, the convenience of a user who operates the holder unit 100 may be improved.

The holder unit 100 may include a housing 110 coupled to the care compartment 30, and a holder 120 accommodated in the housing 110 or movably provided to protrude from the housing 110.

The holder 120 may be provided to be rotatable with respect to the housing 110. The holder 120 may be provided to pivotally rotate on the housing 100. Therefore, when the user does not use the rack 33, the holder 120 is accommodated in the housing 110, thereby securing a large accommodation space of the care compartment 30.

The rack 33 may include a support groove 37 provided such that the rack 33 is supported on the holder 120 protruding from the housing 110. A plurality of the support grooves 37 may be provided symmetrically on opposite sides of the rack 33. A plurality of the support grooves 37 may be provided on one side of the rack 33.

The plurality of support grooves 37 disposed on one side of the rack 33 may be spaced apart from each other. The support groove 37 may be supported by the holder 120 and the support member 39.

FIG. 6 illustrates that two of the support grooves 37 are provided on one side of the rack 33 to constitute four of the support grooves 37 in total, but the disclosure is not limited thereto. That is, the support groove 37 may have various numbers within the limit corresponding to the number of the holder unit 100 and the support member 39.

The rack 33 may be placed on a holder 120 protruding from the housing 110. The rack 33 may be separated from the holder 120 in a direction opposite to the direction in which the rack 33 is placed on the holder 120.

The rack 33 disposed inside the care compartment 30 is interfered by the left surface 12*c* and the right surface 12*d* so that the movement of the rack 33 in the left and right directions may be restricted. The rack 33 is interfered by the holder 120 and the support member 39 so that the movement of the rack 33 in the downward direction may be restricted.

Because the size of the support groove 39 may be larger than that of the holder 120 or the support member 39, the rack 33 may move in the front and rear directions. However, because the size difference between the support groove 39 and the holder 120 or the support member 39 is not large, the support groove 39 is interfered by the holder 120 or the support member 39 so that the movement of the rack 33 in the front and rear directions may be restricted.

Therefore, the rack 33 supported by the holder 120 and the support member 39 may be prevented from being separated from the holder 120 and the support member 39 in the left and right directions, the front and rear directions, and the downward direction, and may be easily separated from the holder 120 and the support member 39 only in the upward direction.

The clothes care apparatus 1 according to an embodiment of the disclosure may improve the convenience of use through a simple structure of the rack 33 when the user mounts the rack 33 in the care compartment 30 or removes the rack 33 from the care compartment 30.

The rack 33 may include a rack body 34 includes a first rack body 35 directing to the door 20 and a second rack body 36 symmetrically opposite the first rack body 35. The rack 33 may be disposed on the holder 120 such that the first rack body 35 is adjacent to the door 20 or the second rack body 36 is adjacent to the door 20.

That is, the clothes care apparatus 1 according to an embodiment of the disclosure may allow the rack 33 to be disposed through the holder unit 100 and the support member 39 regardless of the front and rear directions of the rack 33. Therefore, the convenience of the user to mount the rack 33 in the inside of the care compartment 30 may be improved.

Figure 7:
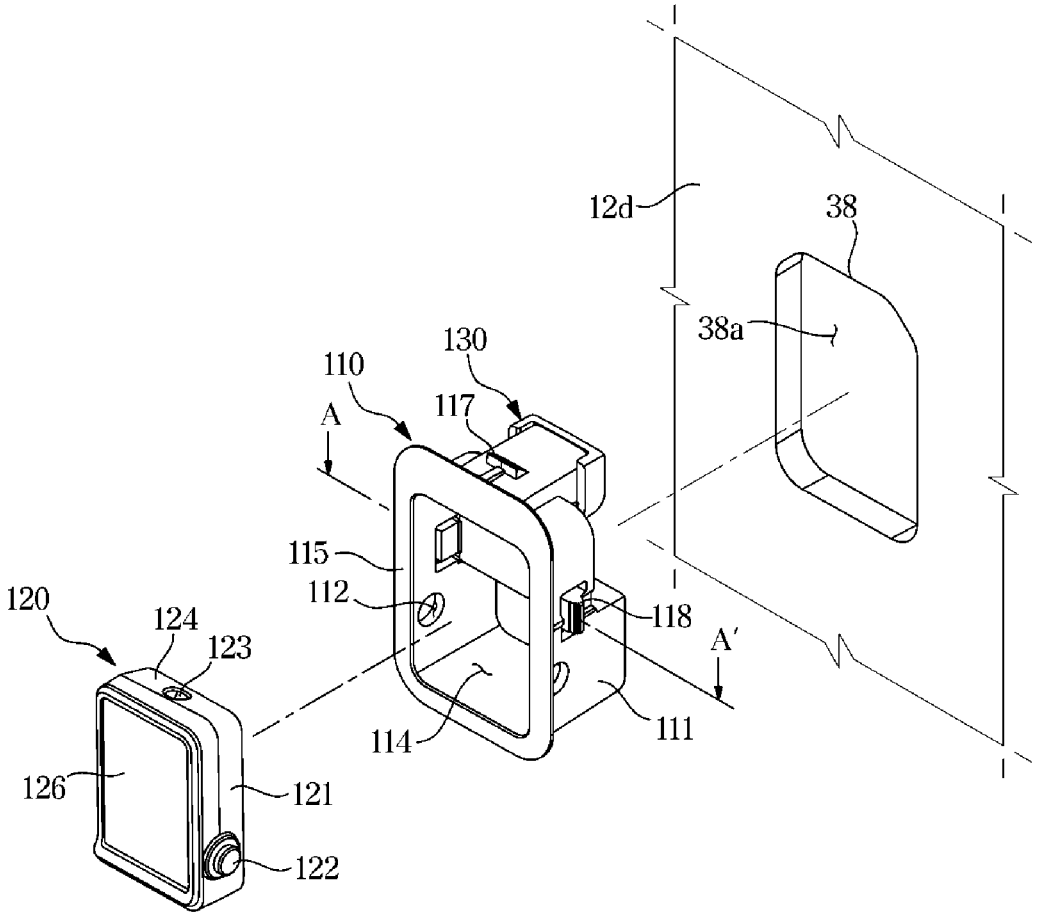
FIG. 7 is an exploded perspective view illustrating a holder unit separated from a coupling portion in the clothes care apparatus according to an embodiment of the disclosure.
Figure 8:
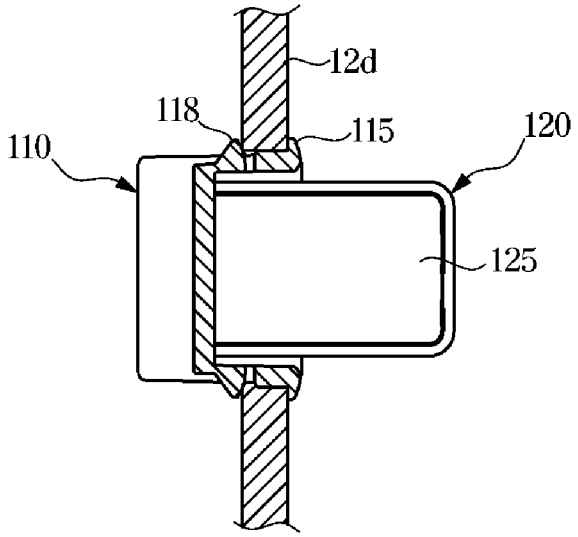
FIG. 8 is a cross-sectional view illustrating the holder unit coupled to the coupling portion, which is viewed from line A-A' in FIG. 7 in the clothes care apparatus according to an embodiment of the disclosure.
Figure 9:
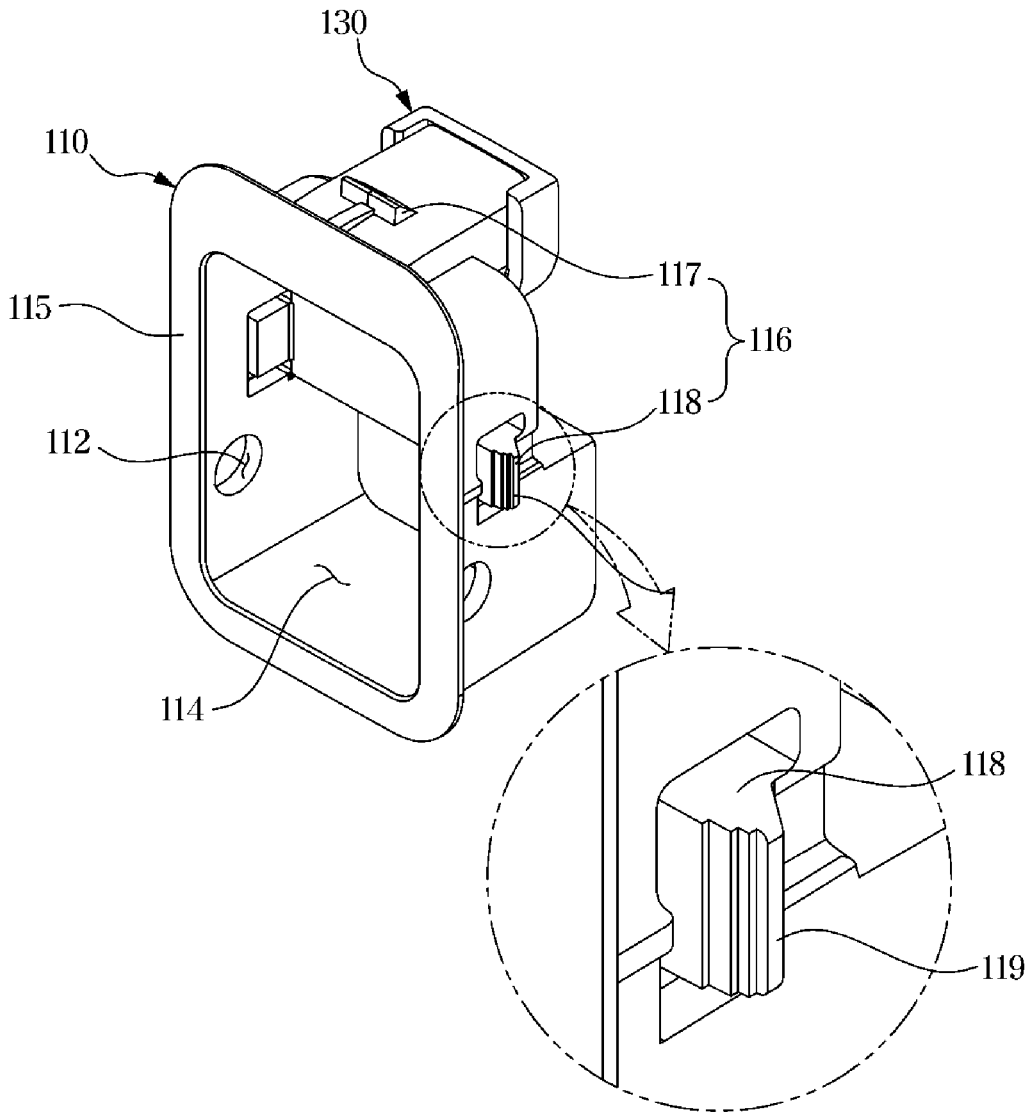
FIG. 9 is an enlarged view of a second fixing portion in the clothes care apparatus according to an embodiment of the disclosure.
Figure 10:
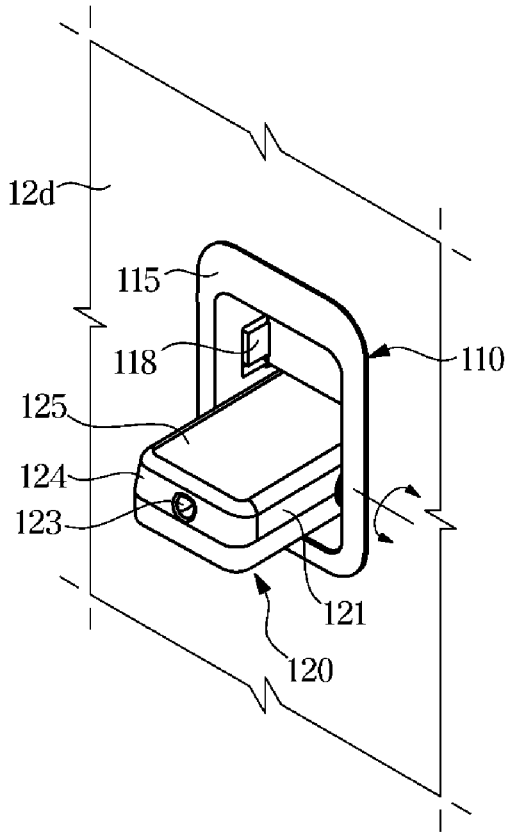
FIG. 10 is a view illustrating a holder rotating with respect to a housing in the clothes care apparatus according to an embodiment of the disclosure.

FIG. 7 is an exploded perspective view illustrating a holder unit separated from a coupling portion in the clothes care apparatus according to an embodiment of the disclosure. FIG. 8 is a cross-sectional view illustrating the holder unit coupled to the coupling portion, which is viewed from line A-A' in FIG. 7 in the clothes care apparatus according to an embodiment of the disclosure. FIG. 9 is an enlarged view of a second fixing portion in the clothes care apparatus according to an embodiment of the disclosure. FIG. 10 is a view illustrating a holder rotating with respect to a housing in the clothes care apparatus according to an embodiment of the disclosure.

As illustrated in FIGS. 7 and 10, the holder unit 100 according to an embodiment of the disclosure may include the housing 110 coupled to the care compartment 30 and the holder 120 provided to be accommodated inside the housing 110 or protrude from the housing 110.

The holder 120 may include a holder body 121 provided to support the rack 33 and a shaft 122 protruding from the holder body 121 to pivotally rotate the holder 120.

Two of the shafts 122 protruding symmetrically from opposite sides of the holder body 121 may be provided. However, the disclosure is limited thereto.

The housing 110 may include a housing body 111 having a receiving portion 114 provided to receive the holder 120, and a shaft hole 112 formed on the housing body 111 such that the shaft 122 is fitted therein.

The receiving portion 114 may be covered by the holder 120 by receiving the holder 120 in the housing 110. Two of the shaft holes 112 may be provided symmetrically on opposite sides of the housing body 111 to correspond to the shaft 122. However, the disclosure is limited thereto.

The shaft 122 and the shaft hole 112 may be disposed at a lower portion of the holder body 121 and the housing body 111, respectively. Thus, the holder 120 may rotate downward. This is the same as the direction in which the holder 120 is rotated by its own weight, thereby reducing the force of the user for rotating the holder 120.

The holder body 121 may include a rack support portion 125 provided to protrude from the housing 110 to support the rack 33, and a rotation prevention portion 126 provided to be opposite to the rack support portion 125 and to be interfered by the housing 110 to prevent the rotation of the holder 120.

The rack support portion 125 may support the support groove 37 (refer to FIG. 6) of the rack 33 (refer to FIG. 6). The rotation prevention portion 126 may restrict the rotation of the holder 120 by being interfered by a lower portion of the housing body 111 forming the receiving portion 114. The rack support portion 125 may support the rack 33 and the lower portion of the housing body 111 may support the rotation prevention portion 126.

Therefore, while a separate additional structure may be required to support the holder 120 that protrudes by rotation when the holder 120 rotates in the upward direction, the holder 120 according to an embodiment of the present invention rotates in the downward direction so that the holder 120 may be supported on the lower portion of the housing 120 in which the holder 120 is accommodated, and thus a separate additional structure for restricting the rotation of the holder 120 is not required.

Coupling portions 38 to which the holder unit 100 is detachably coupled may be provided on the left surface 12*c* (refer to FIG. 4) and the right surface 12*d* of the care compartment 30, respectively. Because the coupling portions 38 provided on the left surface 12*c* and the right surface 12*d* of the care compartment 30 are symmetrical to each other, the following description will be made based on the right surface 12*d* of the care compartment 30 for convenience.

The coupling portion 38 may include a coupling hole 38*a* having a shape corresponding to the housing body 111. The holder unit 100 may be coupled to the coupling portion 38. The holder unit 100 may be coupled to the coupling portion 38 by a fitting manner. The holder unit 100 may be coupled to the coupling portion 38 by a forced fitting manner.

Because the right surface 12*d* constituting the inner cabinet 12 (refer to FIG. 2) has a predetermined elasticity, the holder unit 100 may be forcefully fitted to the coupling portion 38. The area of the housing body 111 may be smaller than area of the coupling hole 38*a*.

The holder unit 100 may be coupled to the coupling portion 38 by the fitting manner from the inside of the care compartment 30 to the outside of the care compartment 30. A portion of the housing body 111 may penetrate the coupling hole 38*a*. A portion of the housing body 111 may be coupled to the coupling portion 38 of the inner cabinet 12 and may be covered by the outer cabinet 11 (refer to FIG. 1).

The housing 110 may include a separation prevention portion 115 provided to prevent the separation of the housing 110 from the coupling portion 38. The separation prevention portion 115 may be provided at an edge of the housing body 111.

The area of the separation prevention portion 115 may be larger than the area of the coupling hole 38*a*. The separation prevention portion 115 may be interfered by the coupling portion 38. As the separation prevention portion 115 is interfered by the coupling portion 38, the holder unit 100 may be prevented from being separated through the coupling hole 38*a* from the inside of the care compartment 30 to the outside of the care compartment 30.

The housing 110 may include a fixing portion 116 protruding from the housing body 111 such that the housing 110 is fixed to the coupling portion 38. The fixing portion 116 may protrude outward from the housing body 111.

As the fixing portion 116 protrudes outward from the housing body 111, a portion of the holder unit 100 provided with the fixing portion 116 may be larger than the area of the coupling hole 38*a*.

As described above, because the right surface 12*d* constituting the inner cabinet 12 has the predetermined elasticity, even if the portion of the holder unit 100 provided with the fixing portion 116 is larger than the area of the coupling hole 38*a*, the holder unit 100 may be forcibly coupled to the coupling hole 38*a* by the fitting manner.

The fixing portion 116 may be interfered by the coupling portion 38. As the fixing portion 116 is interfered by the coupling portion 38, the holder unit 100 may be prevented from being separated through the coupling hole 38*a* from the inside of the care compartment 30 to the outside of the care compartment 30.

The fixing portion 116 may include a first fixing part 117 provided to fix the holder unit 100 to the coupling portion 38, and a second fixing part 118 having elasticity to fix or separate the holder unit 100 to or from the coupling portion 38.

The holder unit 100 may be fixed to the coupling portion 38 through the separation prevention portion 115 and the fixing portion 116. The coupling portion 38 of the care compartment 30 to which the holder unit 100 is coupled may be disposed between the fixing portion 116 and the separation prevention portion 115.

One side surface of the separation prevention portion 115 that faces the coupling portion 38 may be in close contact with the coupling portion 38. One side surface of the fixing portion 116 that faces the coupling portion 38 may be in close contact with the coupling portion 38. Opposite side surfaces of the fixing portion 116 may be in close contact with the separation prevention portion 115 and the fixing portion 116, respectively. The fixing portion 116 may be disposed between the inner cabinet 12 and the outer cabinet 11.

The fixing portion 116 may include a step 119 stepped toward the coupling portion 38 such that the housing 110 is in close contact with the coupling portion 38. The second fixing part 118 may include the step 119 stepped toward the coupling portion 38 such that the housing 110 is in dose contact with the coupling portion 38. However, the disclosure is limited thereto.

As the fixing portion 116 that is in close contact with the coupling portion 38 includes the step 119, the sealing between the coupling portion 38 and the fixing portion 116 may be improved. Therefore, the steam injected into the care compartment 30 from the steam generation device 70 (refer to FIG. 3) may be prevented from leaking to the outside of the care compartment 30 through the coupling hole 38*a*, thereby improving the performance of the clothes care apparatus 1 (refer to FIG. 1).

The step 119 may be provided in various ways such a terrace, a crease, or peaks and valleys within the limit capable of improving the sealing between the fixing portion 116 and the coupling portion 38.

Two of the first fixing part 117 that protrude outward from an upper portion and the lower portion of the housing body 111, respectively, may be provided. Two of the second fixing part 118 that protrude outward from a left side and a right side of the housing body 111, respectively, may be provided. However, the disclosure is limited thereto.

Because the second fixing part 118 has a predetermined elasticity unlike the first fixing part 117, when the holder unit 100 is required to be separated from the coupling portion 38, such as when the holder unit 100 is incorrectly assembled to the coupling portion 38, the user may easily detach the holder unit 100 from the coupling portion 38 by applying a predetermined force to the second fixing part 118.

Figure 11:
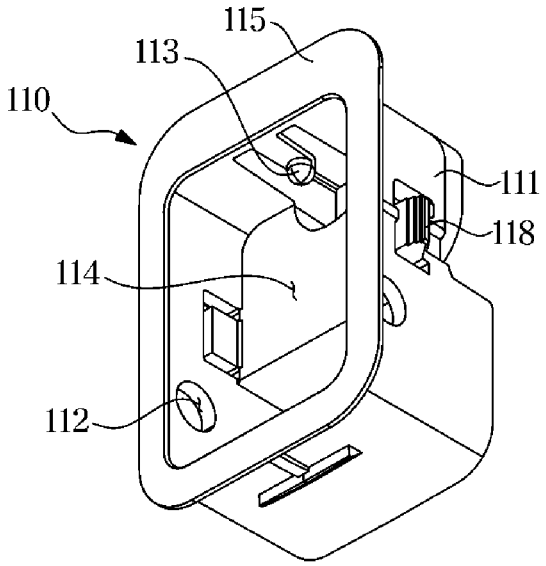
FIG. 11 is a view illustrating a locking portion of the housing in the clothes care apparatus according to an embodiment of the disclosure.

FIG. 11 is a view illustrating a locking portion of the housing in the clothes care apparatus according to an embodiment of the disclosure. As illustrated in FIG. 11, the housing 110 according to an embodiment of the disclosure may include a locking portion 113 provided such that the holder 120 (refer to FIG. 10) is received in the receiving portion 114.

The locking portion 113 may be provided on an upper portion of the receiving portion 114. The locking portion 113 may protrude inward from the upper portion of the receiving portion 114. However, the disclosure is limited thereto. The locking portion 113 may have a predetermined elasticity.

The holder 120 may include a locking groove 123 (refer to FIG. 10) provided such that the rotation of the holder 120 is prevented by the locking portion 113. The locking groove 123 may be provided on an upper portion of the holder body 121 to correspond to the locking portion 113.

The locking portion 113 may include a protrusion and the locking groove 123 may a groove such that the locking portion 113 is interfered by the groove. However, the disclosure is limited thereto.

As the locking groove 123 is locked or unlocked by the locking portion 113, the holder 120 may be received in the receiving portion 114 or protrude from the receiving portion 114.

The user may rotate the holder 120 from the housing 110 by pressing the rotation prevention portion 126 (refer to FIG. 7) to remove the interference between the locking groove 123 and the locking portion 113. The user may rotate the holder 120 from the housing 110 by applying a force greater than the elasticity of the locking portion 113 to the rotation prevention portion 126.

Because the shaft 122 (refer to FIG. 7) of the holder 120 and the shaft hole 112 of the housing 110 are provided on a lower portion of the holder unit 100, the user may rotate the holder 120 from the housing 110 by pressing a lower portion of the rotation prevention portion 126.

The holder 120 may include an inclined portion 124 (refer to FIG. 10) provided to be inclined toward the locking portion 113 such that the locking portion 113 is locked or unlocked to the locking groove 123. The inclined portion 124 may be provided on the upper portion of the holder body 121. The locking groove 123 may be disposed at the inclined portion 124.

Because the shaft 122 of the holder 120 and the shaft hole 112 of the housing 110 are provided on the lower portion of the holder unit 100, the inclined portion 124 may be disposed on the upper portion of the holder body 121 corresponding to an end of a rotation radius of the holder 120.

The inclined portion 124 may minimize collision or interference between the holder 120 and the upper portion of the receiving portion 114.

Figure 12:
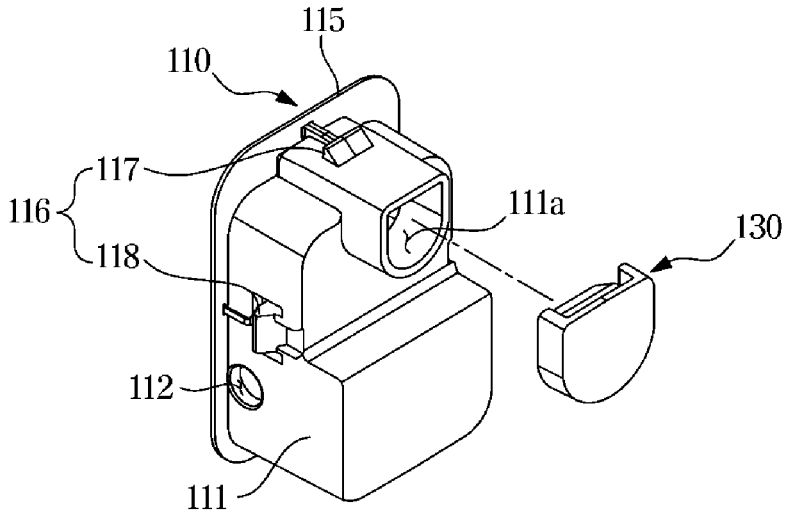
FIG. 12 is a view illustrating a cap for covering a housing hole of the housing in the clothes care apparatus according to an embodiment of the disclosure.

FIG. 12 is a view illustrating a cap for covering a housing hole of the housing in the clothes care apparatus according to an embodiment of the disclosure. As illustrated in FIG. 12, the housing 110 according to an embodiment of the disclosure may include a housing hole 111*a*.

The housing hole 111*a* may be provided on an upper portion of housing body 111. However, the disclosure is limited thereto. The housing hole 111*a* may be provided for ease of injection molding of the housing 110.

The holder unit 100 according to an embodiment of the disclosure may include a cap 130 for covering the housing hole 111*a* to prevent leakage of steam that is injected into the care compartment 30 from the steam generation device 70 (refer to FIG. 3) through the housing hole 111*a*.

The cap 130 may be detachably provided at the housing body 111 to cover the housing hole 111*a*. The cap 130 may be detachably coupled to the rear of an upper portion of the housing body 111 on which the housing hole 111*a* is formed.

The cap 130 may include a rubber material. However, the disclosure is not limited thereto, and the cap 130 may include various materials and structures within the limit capable of sealing the housing hole 111*a*.

As the cap 130 covers and seals the housing hole 111*a*, the steam injected into the care compartment 30 from the steam generation device 70 may be prevented from leaking to the outside of the care compartment 30 through the housing hole 111*a*, thereby improving the performance of the clothes care apparatus 1 (refer to FIG. 1).

As is apparent from the above, a clothes care apparatus according to an embodiment of the disclosure can allow a user to easily handle a rack by including a holder unit having an improved structure to support the rack.

The clothes care apparatus according to an embodiment of the disclosure can improve the convenience of the user in using the holder unit by including a holder improved to be received in a housing or protrude from the housing.

The clothes care apparatus according to an embodiment of the disclosure can improve performance by including the holder unit improved to prevent air inside a care compartment from leaking outside the care compartment.

Although the technical idea of the disclosure has been described above with reference to specific embodiments, the scope of rights of the disclosure is not limited to these embodiments.

It will be understood by those skilled in the art that various changes in form and details may be made therein without departing from the spirit and scope of the disclosure as defined by the appended claims and their equivalents.

What is claimed is:

1. A clothes care apparatus comprising:

a main body including a care compartment configured to accommodate clothes, the care compartment including a right side wall and a left side wall facing each other;

a rack detachably disposed in the care compartment and having a plurality of support grooves; and a pair of holder units configured to support the rack, each of the pair of holder units including:

a housing body inserted in one of the right side wall and the left side wall, and a holder installed in the housing body and configured to be rotatable from a first position where the holder is disposed in the housing body to a second position where the holder is disposed to protrude from the housing body and extend into one of the plurality of support grooves to support the rack, wherein each of the right side wall and the left side wall includes a recessed portion in which the housing body is inserted, and wherein the housing body includes a first fixing portion protruding from the housing body and a second fixing portion elastically disposed at the housing body such that the second fixing portion is deformed when the housing body is inserted in the recessed portion.

2. The clothes care apparatus according to claim 1, wherein the holder includes a holder body configured to support the rack and a shaft protruding from the holder body and insertable into the housing to support a rotation of the holder.

3. The clothes care apparatus according to claim 2, wherein the housing body includes a shaft hole provided on the housing body to receive the shaft.

4. The clothes care apparatus according to claim 1, wherein the housing body includes a separation prevention portion disposed at an edge of the housing body to prevent the housing body from being unintentionally separated from the recessed portion.

5. The clothes care apparatus according to claim 1, wherein each of the pair of holder units further includes a locking portion configured to prevent an unintentional rotation of the holder, and the holder further includes a locking groove configured to receive the locking portion.

6. The clothes care apparatus according to claim 5, wherein the holder further includes an inclined portion on which the locking groove is disposed and inclined toward the locking portion such that the locking portion is lockable in conjunction with the locking groove.

7. The clothes care apparatus according to claim 1, further comprising a door rotatably coupled to the main body to open and close the care compartment; and a pair of supports each of which protrudes from one of the right side wall and the left side wall to be coupled to one of the plurality of support grooves.

* * * * *